US005265682A

United States Patent [19]

Russell et al.

[11] Patent Number: 5,265,682

[45] Date of Patent: Nov. 30, 1993

[54] STEERABLE ROTARY DRILLING SYSTEMS

[75] Inventors: Michael K. Russell; John D Barr, both of Cheltenham, England

[73] Assignee: Camco Drilling Group Limited, Stonehouse, England

[21] Appl. No.: 901,748

[22] Filed: Jun. 22, 1992

[30] Foreign Application Priority Data

Jun. 25, 1991 [GB] United Kingdom ..... 9113713
Aug. 30, 1991 [GB] United Kingdom ..... 9118618

[51] Int. Cl.[5] ..... E21B 47/02

[52] U.S. Cl. ..... 175/45; 175/61; 175/73

[58] Field of Search ..... 175/45, 61, 73, 24, 175/38

[56] References Cited

U.S. PATENT DOCUMENTS

| | | | |
|---|---|---|---|
| 3,637,032 | 1/1972 | Jeter | 175/73 |
| 4,040,494 | 8/1977 | Kellner | 175/45 |
| 4,291,773 | 9/1981 | Evans | 175/61 |
| 4,637,479 | 1/1987 | Leising | 175/45 X |
| 4,714,118 | 12/1987 | Baker et al. | 175/45 X |
| 4,836,301 | 6/1989 | Van Dongen et al. | 175/61 |

FOREIGN PATENT DOCUMENTS

| | | |
|---|---|---|
| 204474 | 12/1986 | European Pat. Off. . |
| 3535498 | 4/1986 | Fed. Rep. of Germany . |
| 3604270 | 7/1987 | Fed. Rep. of Germany . |
| 9005235 | 5/1990 | PCT Int'l Appl. . |
| 2246151 | 1/1992 | United Kingdom . |

*Primary Examiner*—Hoang C. Dang

[57] ABSTRACT

A system for maintaining a downhole instrumentation package in a roll stabilised orientation with respect to a drill string comprises an instrument carrier which is mounted within a drill collar for rotation about the longitudinal axis of the collar. An impeller is mounted on the instrument carrier so as to rotate the carrier relatively to the drill collar as a result of the flow of drilling fluid along the drill collar during drilling. The torque transmitted to the instrument carrier is controlled, in response to signals from sensors in the carrier which respond to the rotational orientation of the carrier, and input signals indicating the required roll angle of the carrier, so as to rotate the carrier in the opposite direction to the drill collar and at the same speed, so as to maintain the carrier non-rotating in space and hence roll stabilised. The torque may be controlled by controlling a variable coupling between the impeller and the carrier and/or by controlling a brake between the carrier and the drill collar.

24 Claims, 10 Drawing Sheets

STEERABLE ROTARY DRILLING SYSTEMS

BACKGROUND OF THE INVENTION

The invention relates to steerable rotary drilling systems and provides, in particular, apparatus and methods for determining the instantaneous rotational orientation of a rotating drill bit, (the roll angle), in such a system.

When drilling or coring holes in sub-surface formations, it is sometimes desirable to be able to vary and control the direction of drilling, for example to direct the borehole towards a desired target, or to control the direction horizontally within the payzone once the target has been reached. It may also be desirable to correct for deviations from the desired direction when drilling a straight hole, or to control the direction of the hole to avoid obstacles.

"Rotary drilling" is defined as a system in which a downhole assembly, including the drill bit, is connected to a drill string which is rotatably driven from the drilling platform. The established methods of directional control during rotary drilling involve variations in bit weight, r.p.m. and stabilisation. However, the directional control which can be exercised by these methods is limited and conflicts with optimising bit performance. Hitherto, therefore, fully controllable directional drilling has normally required the drill bit to be rotated by a downhole motor, either a turbine or PDM (positive displacement motor). The drill bit may then, for example, be coupled to the motor by a double tilt unit whereby the central axis of the drill bit is inclined to the axis of the motor. During normal drilling the effect of this inclination is nullified by continual rotation of the drill string, and hence the motor casing, as the bit is rotated by the motor. When variation of the direction of drilling is required, the rotation of the drill string is stopped with the bit tilted in the required direction. Continued rotation of the drill bit by the motor then causes the bit to drill in that direction.

The instantaneous rotational orientation of the motor casing is sensed by survey instruments carried adjacent the motor and the required rotational orientation of the motor casing for drilling in the appropriate direction is set by rotational positioning of the drill string, from the drilling platform, in response to the information received in signals from the downhole survey instruments. A similar effect to the use of a double tilt unit may be achieved by the use of a "bent" motor, a "bent" sub-assembly above or below the motor, or an offset stabiliser on the outside of the motor casing. In each case the effect is nullified during normal drilling by continual rotation of the drill string, such rotation being stopped when deviation of the drilling direction is required.

Although such arrangements allow accurately controlled directional drilling to be achieved, using a downhole motor to drive the drill bit, there are reasons why rotary drilling is to be preferred.

Thus, rotary drilling is generally less costly than drilling with a downhole motor. Not only are the motor units themselves costly, and require periodic replacement or refurbishment, but the higher torque at lower rotational speeds permitted by rotary drilling provide improved bit performance and hence lower drilling cost per foot.

Also, in steered motor drilling considerable difficulty may be experienced in accurately positioning the motor in the required rotational orientation, due to stick/slip rotation of the drill string in the borehole as attempts are made to orientate the motor by rotation of the drill string from the surface. Also, rotational orientation of the motor is affected by the wind-up in the drill string, which will vary according to the reactive torque from the motor and the angular compliance of the drill string.

Accordingly, some attention has been given to arrangements for achieving a fully steerable rotary drilling system.

For example, Patent Specification No. WE090/05235 describes a steerable rotary drilling system in which the drill bit is coupled to the lower end of the drill string through a universal joint which allows the bit to pivot relative to the string axis. The bit is contra-nutated in an orbit of fixed radius and at a rate equal to the drill string rotation but in the opposite direction. This speed-controlled and phase-controlled bit nutation keeps the bit heading off-axis in a fixed direction.

British Patent Specification No. 2246151 describes an alternative form of steerable rotary drilling system in which an asymmetrical drill bit is coupled to a mud hammer. The direction of the borehole is selected by selecting a particular phase relation between rotation of the drill bit and the periodic operation of the mud hammer.

U.S. Reissue Pat. No. Re 29526 describes a steerable rotary drilling system in which a pendulum is mounted in the drill pipe close to the bit to assume a vertical position in the azimuthal plane of the drill pipe. When the position of the pendulum is such that the inclination of the drill pipe is not a preselected amount or the azimuthal direction of the pipe is not the preselected direction, a lateral force is imposed on the drill bit urging it to drill in a direction that will return the drill pipe to the preselected inclination or azimuthal direction. The pendulum and its associated apparatus are roll stabilised, that is to say they are rotated in the direction opposite the direction that the drill pipe is rotated and at the same speed, so that the pendulum is substantially non-rotative relative to the earth.

In all of the above-described arrangements it is necessary, in order to achieve the required control, to be able to determine continuously the instantaneous rotational orientation of the rotating drill bit (or in practice a drill collar or other rotatable part associated therewith) since the rotational orientation of the bit at any instant is an essential input parameter for the control system. The instantaneous rotational orientation of the drill bit may be derived from downhole instrumentation, but problems arise in deriving signals which indicate the instantaneous rotational position of the bit with the necessary accuracy, since such signals are liable to be corrupted by high frequency vibrations resulting from the rotation of the drill string.

In the case where the drill bit is driven by a downhole motor, as explained above, rotation of the drill string is stopped when deviation of the drilling direction is required. The downhole instrumentation is therefore non-rotating when measuring the rotational orientation of the drill collar. Accordingly, the signals from the downhole instruments are unvarying (or varying only slowly) and any corruption of the signals by high frequency vibration may therefore be readily filtered out. Such filtering may be effected by processing the signals electronically or by employing instruments which are inherently unresponsive to high frequency vibration. The rotational orientation of the drill collar may therefore be readily computed using signals from sensors in the form of triads of mutually orthogonal linear accelerometers or magnetometers.

In many types of steerable rotary drilling system, however, measurements of the instantaneous rotational orientation of the drill collar must be taken continuously while the drill collar is rotating, and as a result of this there ma be substantial difficulty in obtaining from the sensors signals which are uncorrupted by high frequency vibration or in filtering out such corruption.

With the drill collar rotating, the principle choice is between having the instrument package, including the sensors, fixed to the drill collar and rotating with it, (a so-called "strapped-down" system) or having the instrument package remain essentially stationary as the drill collar rotates around it (a so-called "roll stabilised" system).

SUMMARY OF THE INVENTION

The present invention relates to roll stabilised systems and sets out to provide improved forms of such systems in steerable rotary drilling systems.

According to the invention there is provided a system for maintaining a downhole instrumentation package in a roll stabilised orientation with respect to a drill string, comprising:

- a support connectable to a drill string;
- an instrument carrier carried by the support;
- means carried by the support for permitting the instrument carrier to rotate about the instrument carrier's longitudinal axis;
- a rotatable impeller mounted on the instrument carrier for rotation by a flow of drilling fluid over the impeller;
- means coupling the impeller to the instrument carrier for transmitting a torque to the instrument carrier to cause it to rotate about its longitudinal axis relatively to the support in a direction opposite to the direction of rotation of the support and drill string;
- sensors carried by the instrument carrier for sensing the rotational orientation of the instrument carrier about its longitudinal axis and producing a signal indicative of said rotational orientation;
- control means for controlling, in response to said signal, the torque applied to the instrument carrier to vary the rate of rotation of the instrument carrier relatively to the support, to provide roll stabilisation of the instrument carrier with respect to the support and the drill string.

Preferably the longitudinal axis of the instrument carrier is coincident with the central longitudinal axis of the drill string, and the impeller is rotatably mounted on the instrument carrier for rotation about the longitudinal axis of the instrument carrier.

The means coupling the impeller to the instrument carrier may include an electro-magnetic coupling acting as an electrical generator, the torque transmitted to the carrier by the coupling being controlled by means to control the electrical load applied to the generator output in response to said output signal from the roll sensors and to a signal indicative of the desired rotational orientation of the carrier. The electro-magnetic coupling, acting as an electrical generator, may comprise a rotor rotating with the impeller and a stator fixed to the carrier. The stator may be located within an internal compartment of the carrier, the rotor being located externally of the carrier and the rotor and stator being separated by a cylindrical wall of said compartment.

Alternatively, both the rotor and stator of the electrical generator may be located within an internal compartment of the carrier, the impeller being coupled to the rotor by a transmission through a wall of said compartment. The transmission may include a magnetic coupling acting across said wall of the compartment. A reduction gearbox may be connected between the impeller and the rotor of the electrical generator.

In the above arrangements the impeller and generator are operating as a servo motor and the control of the load on the generator in response to the output signals from the roll sensors constitutes a servo loop. The output signals from the roll sensors will give a good long term error signal for the rotational orientation of the instrument carrier, but such signals will be subject to high frequency noise. Some filtration of this noise may be effected, but this is in conflict with stabilisation of the servo loop. The servo loop could be stabilised by the use of a free roll gyro or a rate roll gyro. However, such components are expensive and can be fragile in the downhole environment.

In alternative arrangements according to the invention, the means for controlling the torque applied to the instrument carrier may include controllable braking means applied between the carrier and the aforesaid support on which the carrier is rotatably mounted. The braking means are preferably located within an internal compartment of the carrier and are connected to said support by a transmission which includes a magnetic coupling acting across a wall of the compartment. In such arrangements the impeller may be directly mechanically coupled to the carrier.

The braking means may comprise an electrical generator having a rotor connected to the support and a stator connected to the instrument carrier, the torque absorbed by the generator being controlled by means to control the electrical load applied to the generator output in response to said output signal from the roll sensors and to a signal indicative of the desired rotational orientation of the carrier. A reduction gearbox may be connected between the rotor and the support.

In one embodiment according to the invention where an electrical generator driven by the impeller, the impeller may supply electrical power to an electric servo motor, carried by the instrument carrier, which servo motor has an output shaft connected to the support, for example through a magnetic coupling, to effect rotation of the instrument carrier relatively to the support. The output shaft of the servo motor may be connected to the support through a reduction gearbox.

In a further embodiment according to the invention the means coupling the impeller to the instrument carrier for transmitting a torque thereto comprises:

- a first shaft rotatably mounted on the instrument carrier;
- means drivably coupling the impeller to the first shaft;
- a second shaft rotatably mounted on the instrument carrier;
- means coupling the second shaft to the support on which the instrument carrier is rotatably mounted;
- a differential gear mechanism coupling the first shaft to the second shaft; and
- an electro-magnetic motor/generator mounted on the instrument carrier and connected to the differential gear mechanism to transmit torque from said mechanism to the instrument carrier; and means controlling the motor/generator, in response to the aforesaid signal indicative of the rotational orientation of the instrument carrier, to control the torque applied to the instrument carrier.

The system may further comprise an electrical generator driven by the impeller, the generator comprising a rotor driven by said first shaft and a stator mounted on the instrument carrier.

In any of the arrangements according to the invention the roll sensors may comprise a triad of mutually orthogonal linear accelerometers or magnetometers.

The invention also provides a steerable rotary drilling system comprising a roll stabilised instrument assembly having an output control shaft the rotational orientation of which represents a desired direction of steering, a bottom hole assembly including a bit structure and a synchronous modulated bias unit including means for applying to the bit structure a displacement having a lateral component at right angles to the axis of rotation of the bit structure, means operated by rotation of the bias unit relatively to said output control shaft for modulating said lateral displacement component in synchronism with rotation of the bit structure, and in a phase relation thereto determined by the rotational orientation of the control shaft, whereby the maximum value of said lateral displacement component is applied to the bit structure at a rotational orientation thereof dependant on the rotational orientation of the control shaft, thereby to cause the bit structure to become displaced laterally in said desired direction as drilling continues, and means for decoupling the control shaft from the roll stabilised instrument assembly and/or from the bias unit while maintaining the integrity of said assembly and bias unit respectively. The bias unit may be incorporated in the bit structure, and the roll stabilised instrument assembly may be of any of the kinds referred to above.

The invention further provides a method of maintaining a downhole instrumentation package in a roll stabilised orientation with respect to a drill string, comprising the steps of:

mounting the instrumentation package in an instrument carrier which is rotatable about a longitudinal axis relatively to the drill string;

rotating the instrument carrier about its longitudinal axis by means of an impeller disposed in a flow of drilling fluid passing along the drill string; and controlling the torque applied to the instrument carrier, in response to signals indicative of the rotational orientation of the instrument carrier, to vary the rate of rotation of the instrument carrier relatively to the drill string to provide roll stabilisation of the instrument carrier with respect to the drill string.

DETAILED DESCRIPTION OF THE PREFERRED EMBODIMENTS

Figure 11:
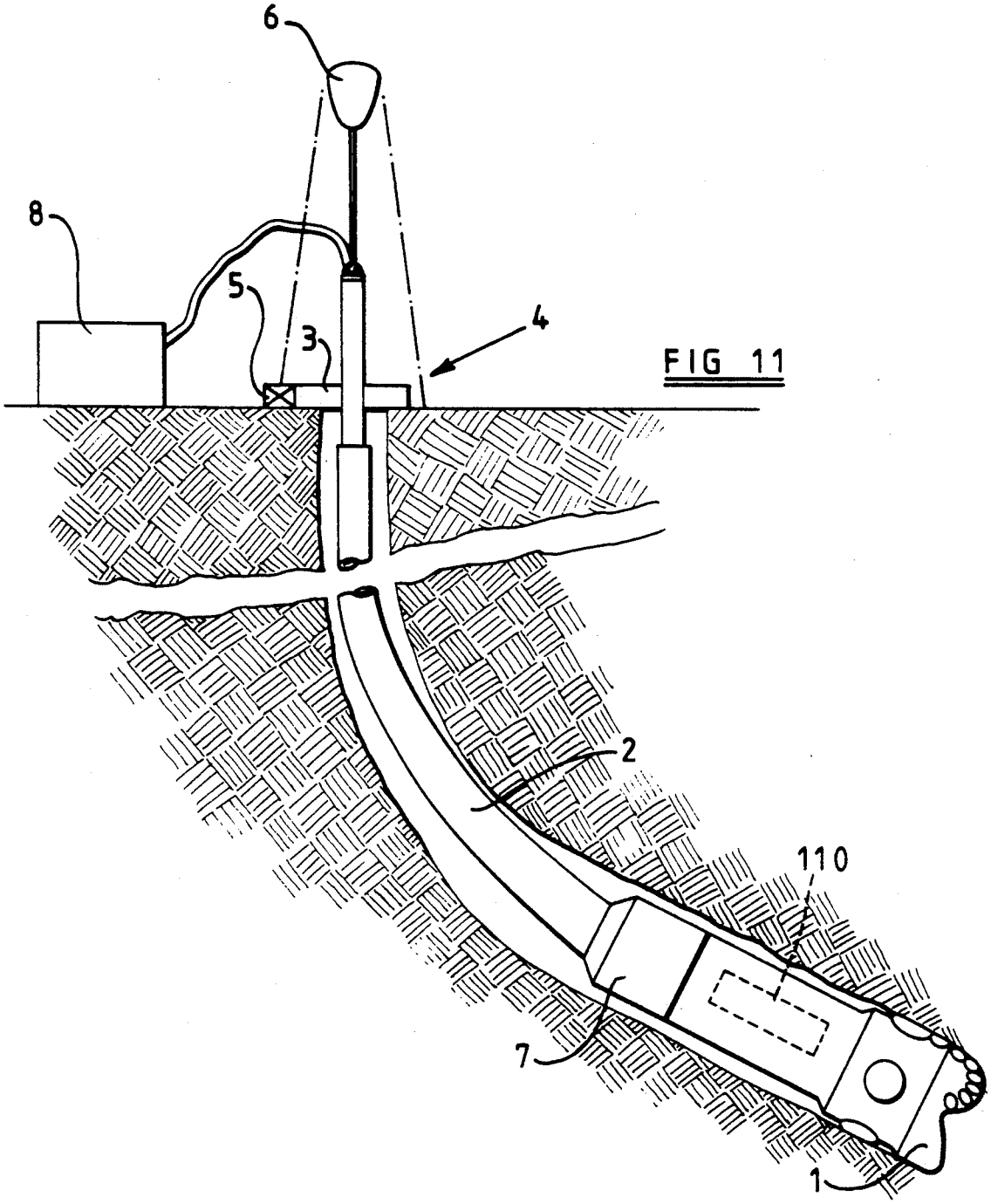
FIG. 11 is a diagrammatic sectional representation of a deep hole drilling installation.

Reference will first be made to FIG. 11 which shows diagrammatically a typical rotary drilling installation of the kind in which the system according to the present invention may be employed.

As is well known, the bottom hole assembly includes a drill bit 1 which is connected to the lower end of a drill string 2 which is rotatably driven from the surface by a rotary table 3 on a drilling platform 4. The rotary table is driven by a drive motor indicated diagrammatically at 5 and raising and lowering of the drill string, and application of weight-on-bit, is under the control of draw works indicated diagrammatically at 6.

The bottom hole assembly includes an MWD (measurement while drilling) package 7 which transmits to the surface signals, indicated at 8, indicative of the parameters, such as orientation, under which the drill bit 1 is operating. The drive motor 5, draw works 6 and pumps 8 are controlled, in known manner, in response to inputs relating to the desired performance of the drill bit.

As previously explained, when the bottom hole assembly is a steerable system, for example of the kind which will be described in relation to FIGS. 9 and 10, it is necessary for the steering system, while steering is taking place, to be continuously controlled by signals responsive to the instantaneous rotational orientation of the drill bit. The present invention relates to a system for roll stabilisation of the instrument package which supplies such continuous signals to the steering assembly and also to the MWD transmitter 7. The roll stabilised system is indicated generally at 110 in FIG. 11 and embodiments of such system will now be described in relation to FIGS. 1 to 8.

Figure 1:
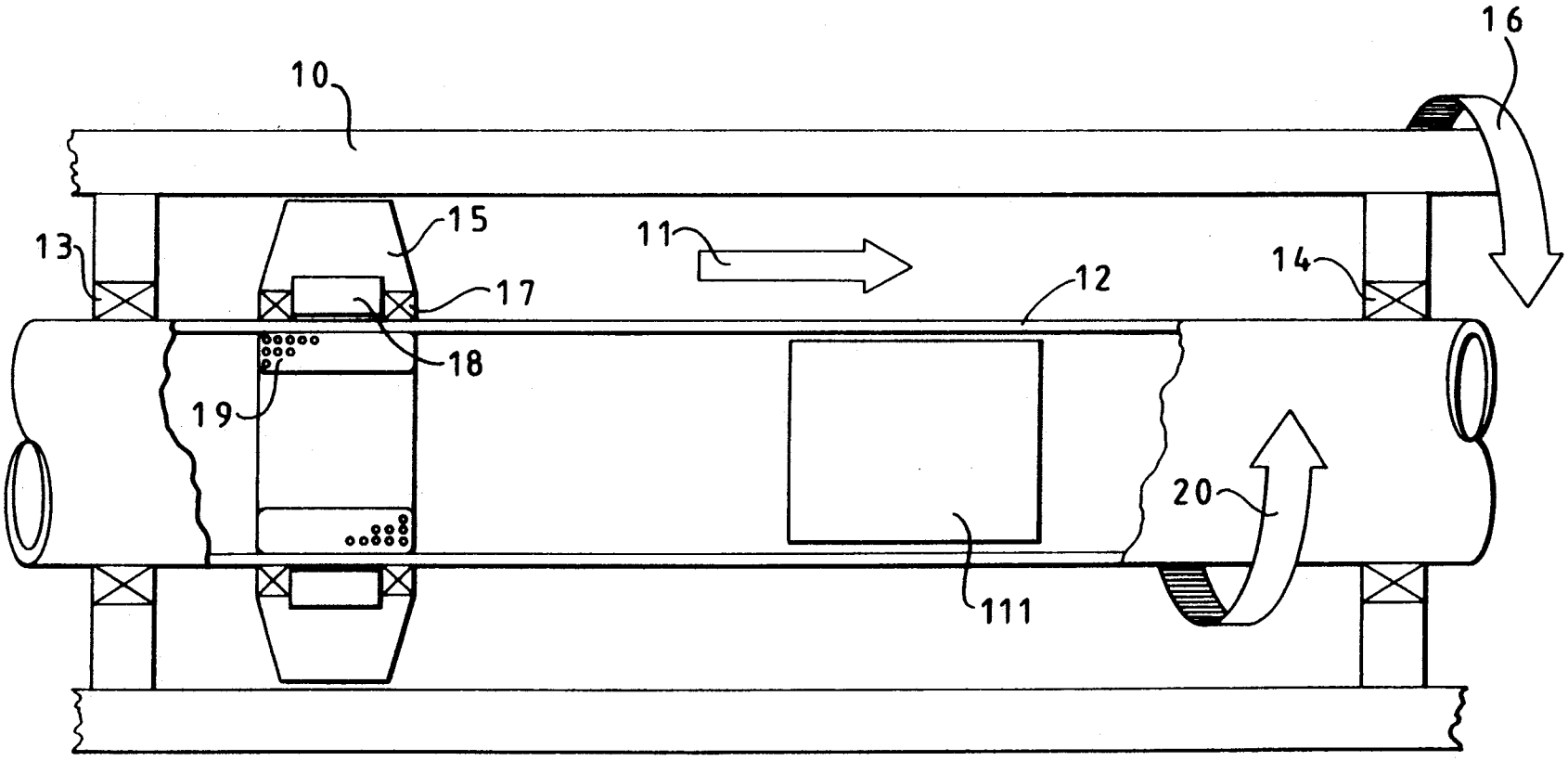
FIG. 1 is a diagrammatic section through a roll stabilised assembly in accordance with the invention.

Referring to the embodiment of FIG. 1, the support for the system comprises a tubular drill collar 10 forming part of the drill string in a steerable rotary drilling system. For example, the steerable system may be of the kind described in British Patent Specification No. 2246151 in which there is mounted on the end of the drill string an asymmetrical drill bit coupled to a mud hammer. Alternatively, the drill string may carry a bottom hole assembly of the kind incorporating a synchronous modulated bias unit, that is to say means for applying to the bit structure a displacement having a lateral component at right angles to the axis of rotation of the bit, and means for modulating the lateral displacement component in synchronism with rotation of the bit, and in selected phase relation thereto, whereby the maximum value of the lateral displacement component is applied to the bit body at a selected rotational orientation thereof, so as to cause the bit structure to become displaced laterally as drilling continues. Drill bit structures of this kind are described in our British Patent Application No. 9118618.9, and a preferred form of such a bit structure is also described below with respect to FIGS. 9 and 10 of the accompany drawings.

However, the assemblies to be described may essentially be used with any form of steerable rotary drilling system where the instrumentation package is required to be roll stabilised.

Referring again to FIG. 1: during drilling operations, as is well known, drilling mud flows downwardly through the drill string, as indicated by the arrow 11, and is delivered to the drill bit to clean and cool the cutters on the bit as well as to return cuttings to the surface.

The system according to the present invention comprises a support in the form of a tubular drill collar 10. An elongate generally cylindrical hollow carrier 12 is mounted in bearings 13, 14, supported within the drill collar 10, for rotation relatively to the drill collar 10 about the central longitudinal axis thereof. The carrier has one or more internal compartments which contain an instrumentation package comprising sensors for sensing the orientation of the carrier and the associated equipment, described in further detail below, for processing signals from the sensors and controlling the rotation of the carrier. The instrumentation package is indicated diagrammatically at 111 in FIG. 1.

The bearings 13, 14 are preferably arranged to be lubricated by the drilling fluid and may consist of rubber running on hard-faced journals.

Downstream of the bearing 13 a multi-bladed impeller 15 is rotatably mounted on the casing of the carrier 12 by means of bearings 17. The bearings 17 may also be lubricated by the drilling fluid. During drilling operations the drill string, including the drill collar 10, will normally rotate clockwise, as indicated by the arrow 16, and the impeller 15 is so designed that it tends to be rotated anti-clockwise as a result of the flow of drilling fluid past the impeller.

The impeller 15 is designed, when rotating about the carrier 12, to act as an electrical torquer-generator. Thus, the impeller may contain, around its inner periphery, an array of permanent magnets as indicated at 18 cooperating with a fixed stator 19 within the casing of the carrier 12. The magnet/stator arrangement serves as a variable drive coupling between the impeller 15 and the carrier 12.

Figure 2:
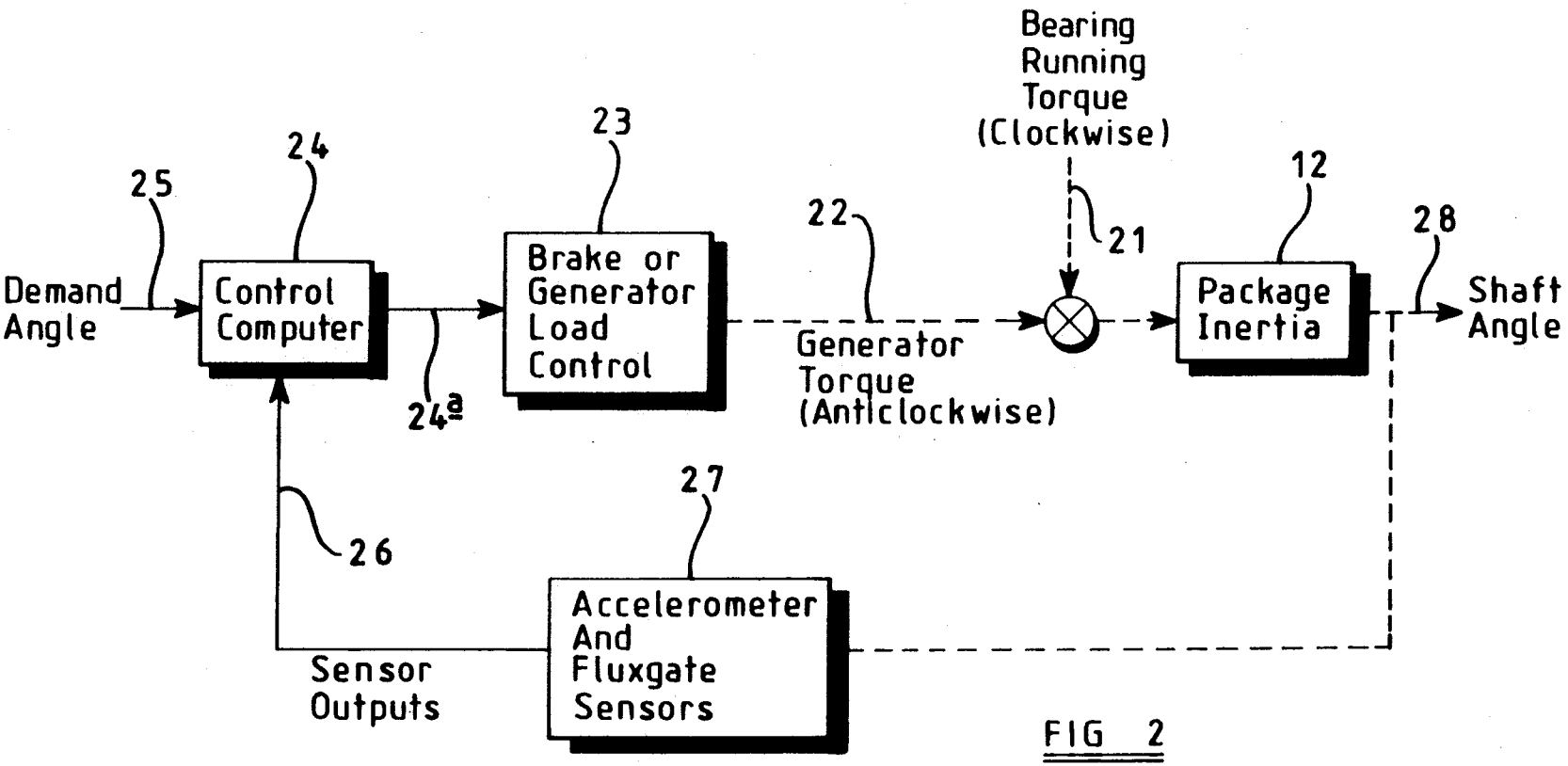
FIG. 2 is a block diagram showing a servo loop which operates to control the assembly in use.

FIG. 2 shows diagrammatically the servo control loop which operates to control the instrument package to zero rate, i.e. to maintain the carrier 12 at a required rotational orientation in space, irrespective of the rotation of the drill collar 10.

As the drill collar 10 rotates during drilling, the main bearings 13, 14 apply a clockwise input torque 21 to the carrier 12, and this is opposed by an anticlockwise torque 22 (indicated by arrow 20 in FIG. 1) applied to the carrier 12 by the impeller 15. This anticlockwise torque is varied by varying the electrical load on the generator constituted by the magnets 18 and the stator 19. This variable load is applied by a generator load control unit 23, under the control of a computer 24. There are fed to the computer 24 an input signal 25 indicative of the required rotational orientation (roll angle) of the carrier 12, and feedback signals 26 from roll sensors 27 mounted on the carrier 12. The input signal 25 may be transmitted to the computer from a manually operated control unit at the surface, or may be derived from a downhole computer program defining the desired path of the borehole being drilled.

The computer 24 is pre-programmed to process the feedback signal 26, which is indicative of the rotational orientation of the carrier 12 in space, and the input signal 25, which is indicative of the desired rotational orientation of the carrier, and to feed a resultant output signal **24*a* to the generator load control unit 23. The output signal 24*a* is such as to cause the generator load control unit 23 to apply to the torquer-generator 18, 19 an electrical load of such magnitude that the torque applied to the carrier 12 by the torquer-generator opposes and balances the bearing running torque 21 so as to maintain the carrier non-rotating in space, and at the rotational orientation demanded by the signal 25**.

The output 28 from the roll stabilised system is provided by the rotational orientation (or shaft angle) of the carrier 12 itself and the carrier can therefore be mechanically connected, for example by a single control shaft, directly to a bias unit, or other steering mechanism, in the bottom hole assembly. Thus no electrical connections, power source or electromechanical devices may be required to control the steerable bit structure, thereby simplifying the construction of the control arrangement for the steering system. An example of such a mechanically controlled steering system is described below in relation to FIGS. 9 and 10.

As previously mentioned, the roll sensors 27 carried by the carrier 12 may comprise a triad of mutually orthogonal linear accelerometers or magnetometers, the output signal 26 from these being passed through a filter and amplifier to the control computer 24. In order to stabilise the servo loop there may also be mounted on the carrier 12 an angular accelerometer. The signal from such an accelerometer already has inherent phase advance and can be integrated to give an angular velocity signal which can be mixed with the signals from the roll sensors to provide an output which accurately defines the orientation of the carrier 12 with sufficient accuracy, regardless of lateral and torsional vibrations to which it may be subject.

Figure 3:
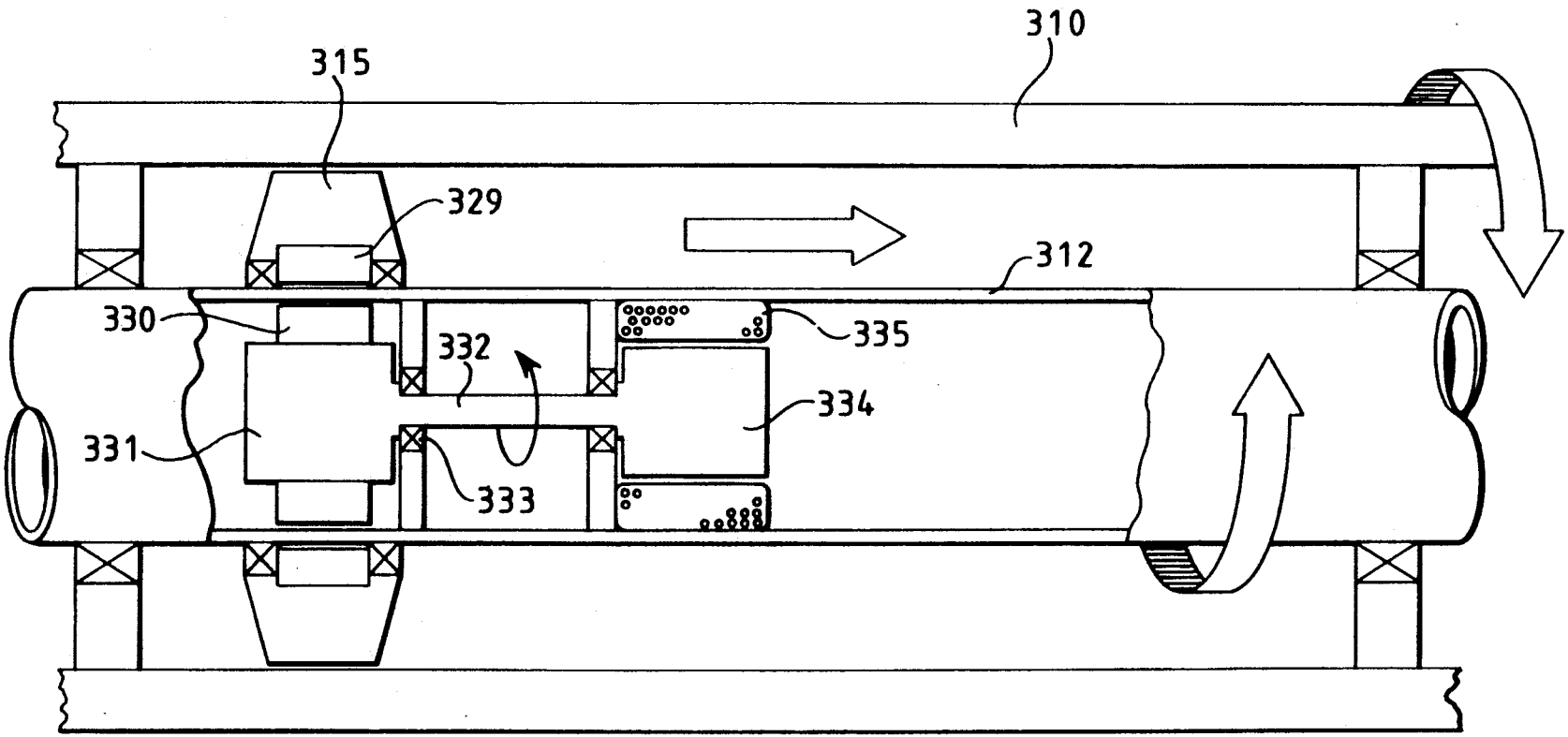
FIGS. 3–8 are further diagrammatic sections, corresponding to FIG. 1, of alternative forms of roll stabilised assembly in accordance with the invention.

In the arrangement of FIG. 1 the impeller 15 and permanent magnets 18 are rotating in the mud flow whereas the stator 19 is located within a compartment in the casing of the carrier 12, which constitutes a pressure housing. Such arrangement may suffer from the disadvantage that the magnet circuit gaps between the permanent magnets and stator are necessarily comparatively large with the result that the size of the torquer-generator provided by the impeller must be increased to compensate for the reduced magnetic fields. FIG. 3 shows an alternative arrangement in which this problem is overcome by locating the torquer-generator entirely within the casing of the carrier, and connecting it to the impeller by a transmission incorporating a magnetic coupling.

Referring to FIG. 3, the magnetic coupling comprises a magnet assembly 329 extending around the inner periphery of the impeller 315 externally of the carrier 312, and a magnet assembly 330 extending around the outer periphery of a rotor 331 within the pressure casing, the rotor 331 being carried by a shaft 332 rotatably mounted in bearings 333. The magnetic coupling provided by the cooperating magnetic assemblies 329 and 330 results in the rotor 331 and shaft 332 rotating with the impeller 315, as the impeller itself is rotated by the flow of mud along the drill collar 310. The construction and operation of such magnetic couplings is well known, and will not therefore be described in further detail.

The end of the shaft 332 remote from the rotor 331 carries a permanent magnet rotor 334 which cooperates with a stator 335 fixed to the casing 312. The rotor 334 and stator 335 assembly then constitute the torquer-generator which applies the controlled anti-clockwise torque 22 in the servo loop of FIG. 2 which effects roll stabilisation of the carrier 312 under the control of the control computer 24. It will be appreciated that since, in this arrangement, the torquer-generator is entirely enclosed within the pressure casing within the carrier 312 the magnetic circuit gaps between the rotor 334 and stator 335 may be designed for optimum performance instead of being determined by the mechanical constraints of the arrangement of FIG. 1. The design of the rotor 334 is also not affected by the space constraints which apply with the magnet assembly 18 on the impeller 15 in the arrangement of FIG. 1.

The torquer-generator 334, 335 is preferably disposed in a compartment within the carrier 312 which is pressure balanced with the drilling mud pressure outside the carrier 312, thereby permitting the wall of the carrier casing to be thinner, and thereby reducing the magnetic circuit gap between the magnet assemblies 329 and 330 of the magnetic coupling. For example the whole compartment within the carrier 312 within which the torquer-generator is located may be filled with clean pressurised oil.

Figure 4:
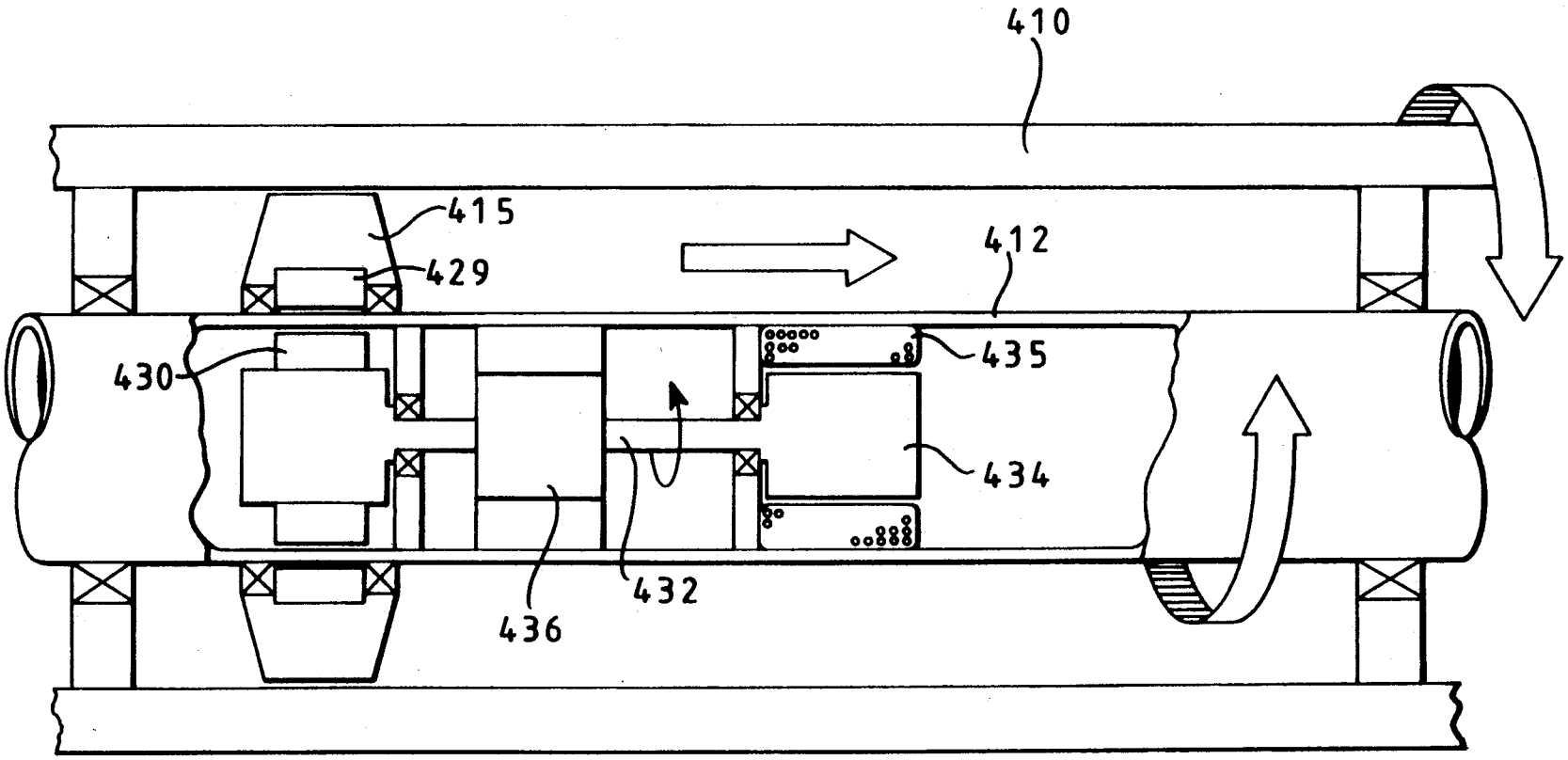

FIG. 4 shows a modified version of the arrangement of FIG. 3 in which there is provided in the shaft 432 a gear box 436, for example an epicyclic gear box, to multiply the torque generated by the torquer-generator. Apart from the inclusion of the gear box 436, the other components of the FIG. 4 arrangement are the same as in the FIG. 3 arrangement and include a drill collar 410, a carrier 412, an impeller 415, a magnetic coupling 429, 430, and a torquer-generator 434, 435.

Figure 5:
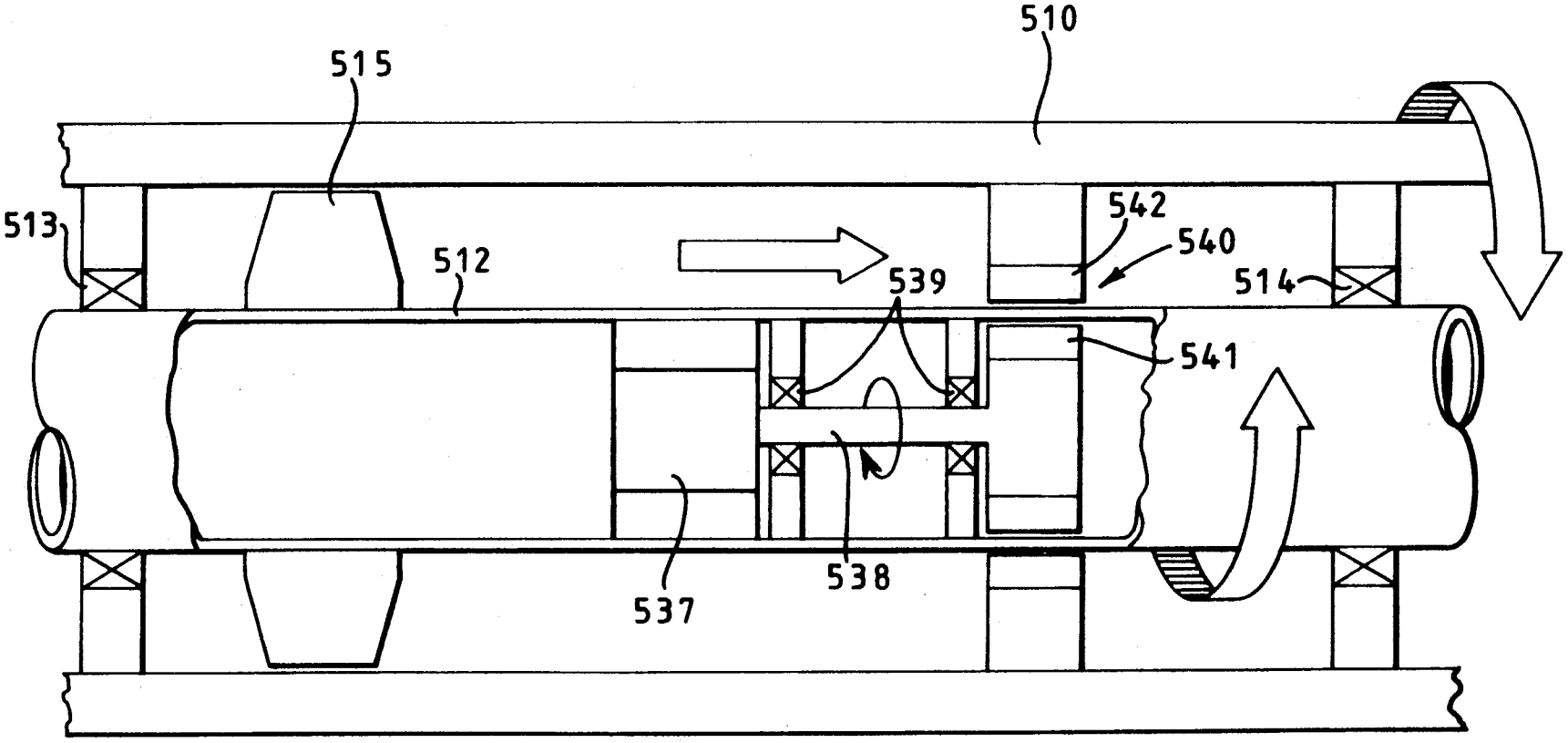

In the arrangements of FIGS. 1 to 4, the impeller is coupled to the carrier through a controllable torquer-generator. FIG. 5 illustrates an alternative arrangement in which the impeller 515 is directly mechanically coupled to the carrier 512 and the output torque is controlled by a variable brake applied between the drill collar and the carrier.

Referring to FIG. 5: as in the previously described arrangements the carrier 512 is mounted in bearings 513, 514 supported within the drill collar 510, for rotation relatively to the drill collar 510 about the central longitudinal axis thereof. In this case, however, the impeller 515 is fixedly mounted on the carrier 512.

As before, the impeller 515 is so designed that it is rotated anti-clockwise as a result of the flow of drilling fluid past the impeller, imparting an anti-clockwise torque to the carrier 512. In this arrangement, however, the output torque from the carrier 512 is controlled by a controllable brake 537, located within the carrier 512 and acting between the carrier and a shaft 538 mounted in bearings 539 within the carrier. The brake 537 may be any suitable form of controllable brake, such as a friction, hydraulic or electro-magnetic brake.

The shaft 538 is connected to the drill collar 510 through a magnetic coupling, indicated generally at 540, comprising a magnet assembly 541 on the end of the shaft 538 cooperating with a stationary magnet assembly 542 disposed around the inside of the drill collar 510 so that the shaft 538 rotates with the drill collar 510 relatively to the carrier 512.

The brake 537 is under the control of the control computer 24 in a servo loop corresponding to that of FIG. 2, and in this case adjustment of the brake under the control of the computer serves to control the output torque and shaft angle 28 of the carrier 512 in response to the input 25 to the control computer and the feedback 26 from the instrument package 27.

In the arrangements of FIGS. 1 to 4, the electric generator driven by the impeller also provides the necessary power for the instruments in the instrument package. In the arrangement of FIG. 5, in the absence of such a generator, other means, such as a battery, may be necessary to provide electrical power for the instrument package in the carrier. In the modified arrangement of FIG. 6, this disadvantage is overcome by providing a brake in the form of an electric generator 643, comprising a rotor 644 mounted on the shaft 638 and rotating within a stator 645 mounted within the casing of the carrier 612. An epicyclic gear box 646 is provided in the shaft 638 to increase the torque supplied by the generator 643. The operation of the system is otherwise generally similar to that of FIG. 5, the output of the generator 643 being under the control of the control computer 24 in a servo loop corresponding to that of FIG. 2.

Figure 7:
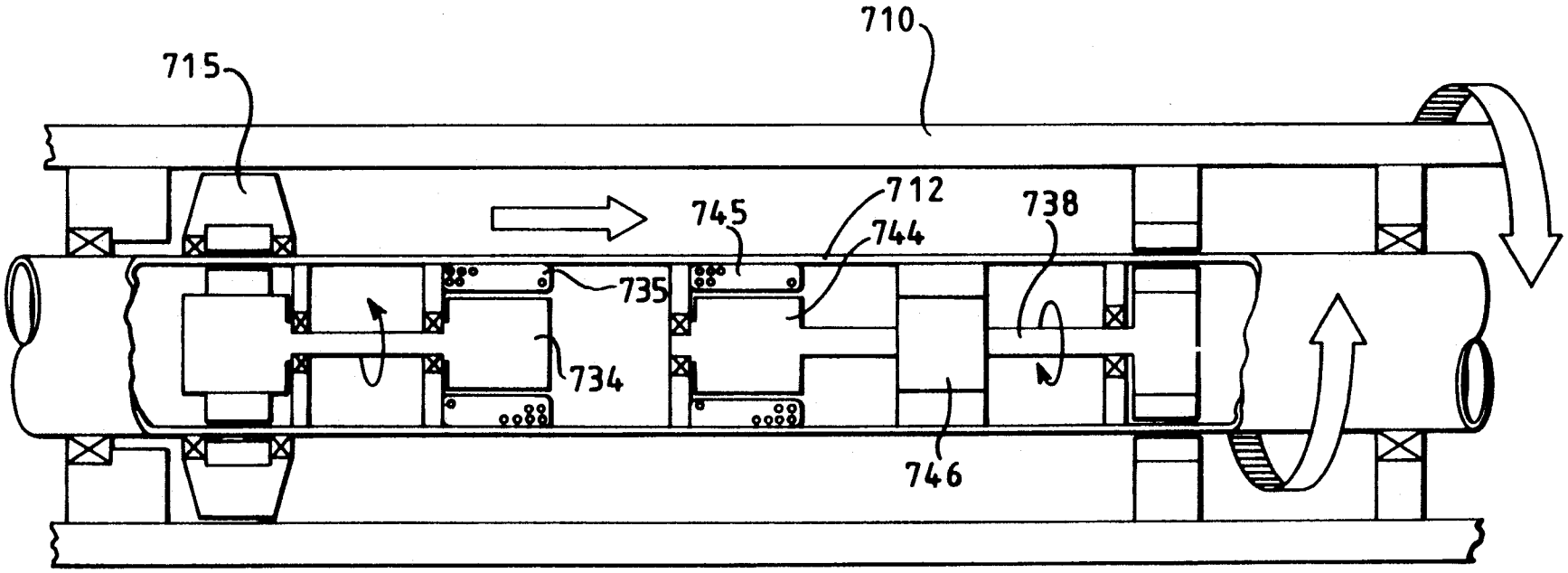

FIG. 7 illustrates a still further alternative arrangement in accordance with the invention. As in the arrangement of FIG. 3, an impeller 715 is magnetically coupled to a generator 734, 735. In this case, however, the generator 734, 735 supplies electric power, via a controlled amplifier (not shown), to a servo motor comprising a stator 745 fixed to the carrier 712 and a rotor 744 connected through an (optional) gear box 746 to a shaft 738 which is magnetically coupled to the drill collar 710. The servo motor 744, 745 thus rotates the carrier 712 anti-clockwise relatively to the drill collar 710, such rotation being controlled, by a servo loop corresponding to that of FIG. 2, to maintain the carrier 712 non-rotating in space, at a desired rotational orientation.

Figure 6:
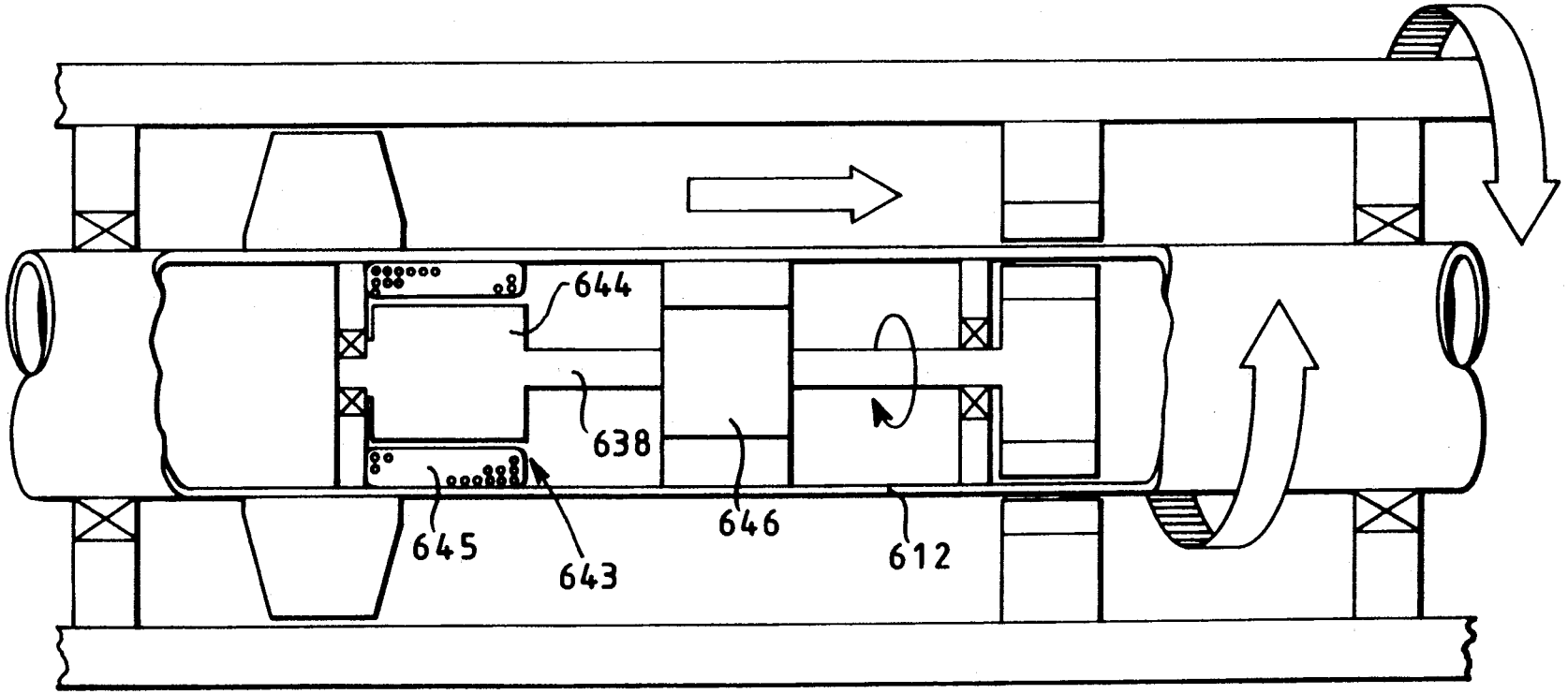

The generator 734, 735 runs at high speed, compared to the generator 643 of the arrangement of FIG. 6, for example, and all the torque generated is therefore multiplied by the mechanical advantage arising from the angular velocity ratio between the impeller 715 and the output. In this arrangement most of the torque comes from the servo motor 744, 745 through the second magnetic coupling. However, the torque from the generator 734, 735 also reacts on the carrier 712 in the same direction, and would increase with servo motor power, but it would be smaller due to its higher speed. This system may make better use of the power from the impeller than the previously described arrangements.

Figure 8:
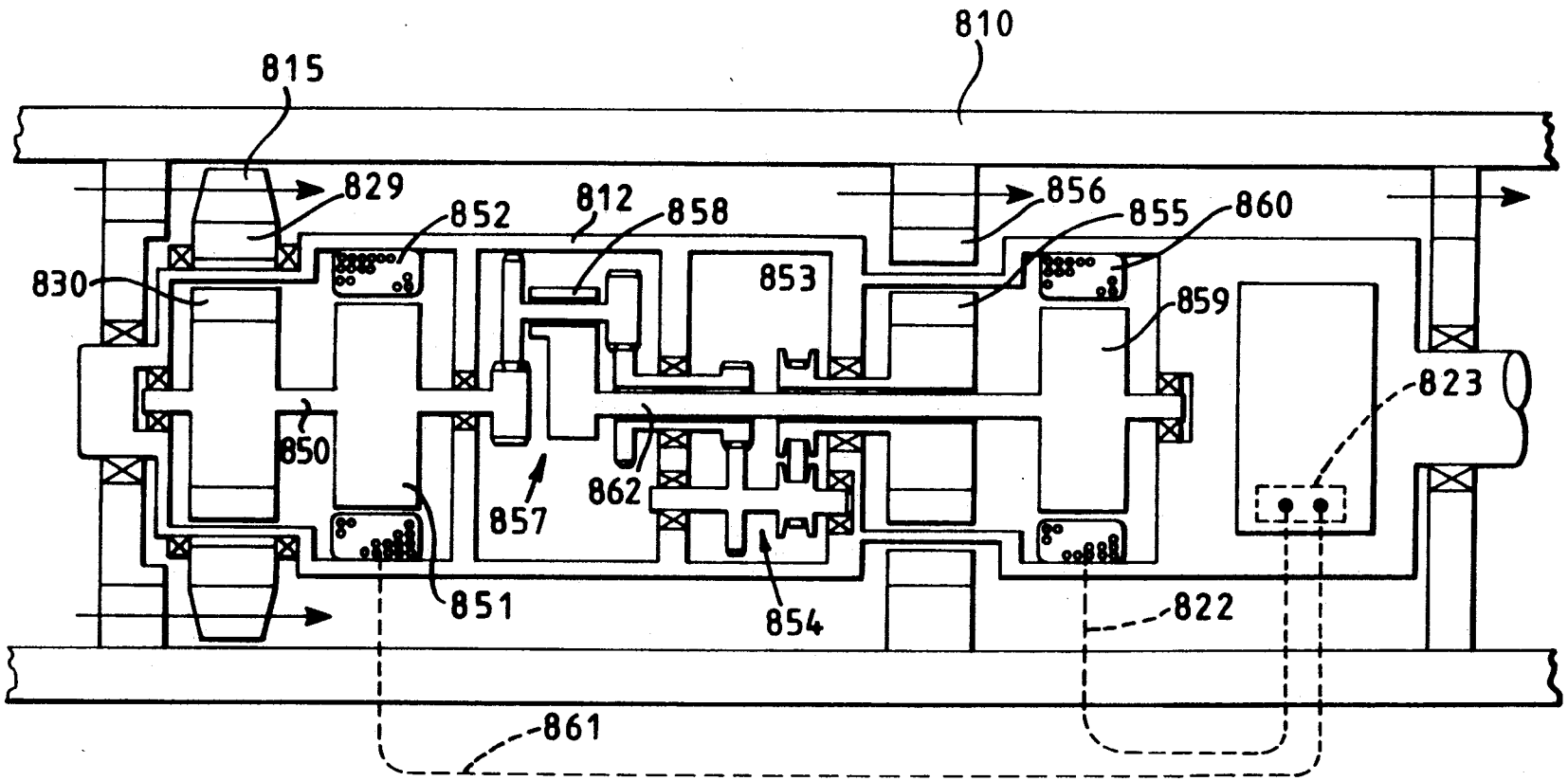

In the arrangement of FIG. 8, the impeller 815 which is rotatably mounted on the carrier 812 is connected by a magnetic coupling 829, 830 to a first shaft 850 on which is mounted the rotor 851 of an electrical generator, the stator 852 of the generator being mounted within the carrier 812. A second shaft 853 rotatably mounted within the carrier 812 is coupled to the drill collar 810 through a reduction gearbox 854 and a further magnetic coupling 855, 856.

The first shaft 850 and second shaft 853 are coaxial and are connected by a spur differential gear mechanism shown diagrammatically at 857. The differential gear mechanism is shown as a simple spur gear differential arrangement for the purposes of clarity and explanation. It will be appreciated, however, that any other form of differential gear may be employed and selected according to the constraints of space within the carrier 812.

The orbiting carrier 858 of the differential gear is mounted on a shaft 862 which is rotatable concentrically within the shaft 853 and carries the rotor 859 of an electric motor/brake, the stator 860 of which is mounted on the carrier 812.

In the arrangement shown the torque applied to the carrier 812 by the impeller 815 is controlled by controlling the motor/brake 859, 860. The ratio of the gearbox 854 is selected to match the impeller torque/speed characteristic with zero output speed from the differential gear box 857. Under the maximum power condition no power is lost in the motor/brake 859, 860 and efficiency is high. For lower output speed conditions the motor/-brake is controlled, by a control signal 822 from a controller 823 in the instrument package, to absorb the speed difference via the differential gear mechanism 857. The speed of rotation of the carrier 812 may thus be controlled by controlling operation of the motor/brake 859, 860, and is controlled, as in the previously described arrangements, so that the carrier remains non-rotatable in space at a desired rotational orientation.

The motor/brake 859, 860 could be used to supply electrical power to the instrument package. However, under certain conditions, for example where the carrier 812 is rotating in space when an output signal is not required from the system, the motor/brake 859, 860 may be stationary or acting as a motor and would not therefore be generating electrical power. In order to ensure that electrical power is available under all conditions, therefore, the generator 851, 852, is coupled to the first shaft 850. It should be appreciated that, in addition to providing the required electrical power for the instrumentation, the generator 851, 852 will also transmit some torque from the impeller 815 to the carrier 812, in the same fashion as the generator 334, 335 in the arrangement of FIG. 3. The electrical load on the generator 851, 852 is therefore also controlled by a signal 861 from the controller 823 so that the overall torque transmitted to the carrier 812 by both the generator 851, 852 and the brake 859, 860 is of the magnitude required to rotate the carrier 812 at such speed relatively to the drill collar 812 that the carrier remains non-rotating in space.

As in the previously described arrangements the controller 823 will be under the control of a pre-programmed computer to deliver the signals 822 and 861 which are appropriate to achieve the required effect in response to input signals to the computer comprising signals from the sensors responsive to the rotational orientation of the carrier and a signal indicative of the desired angular orientation.

The particular details of an appropriate computer control system to achieve the required effects will be within the normal skill of a suitably qualified person. Such details do not therefore form part of the present invention and do not require to be described inn detail.

Figure 9:
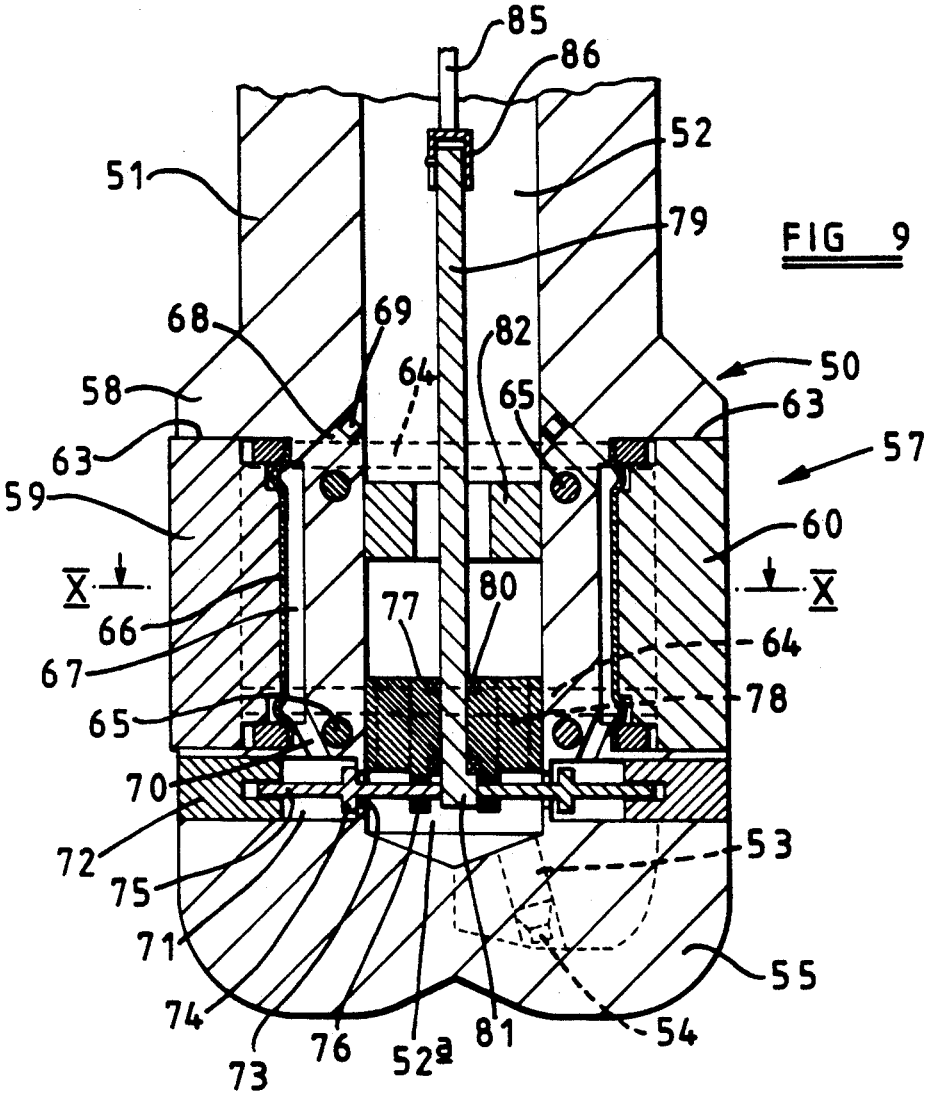
FIG. 9 is a diagrammatic longitudinal section through a steerable PDC drill bit of a kind which may be controlled by the roll stabilised assemblies of FIGS. 1–8.
Figure 10:
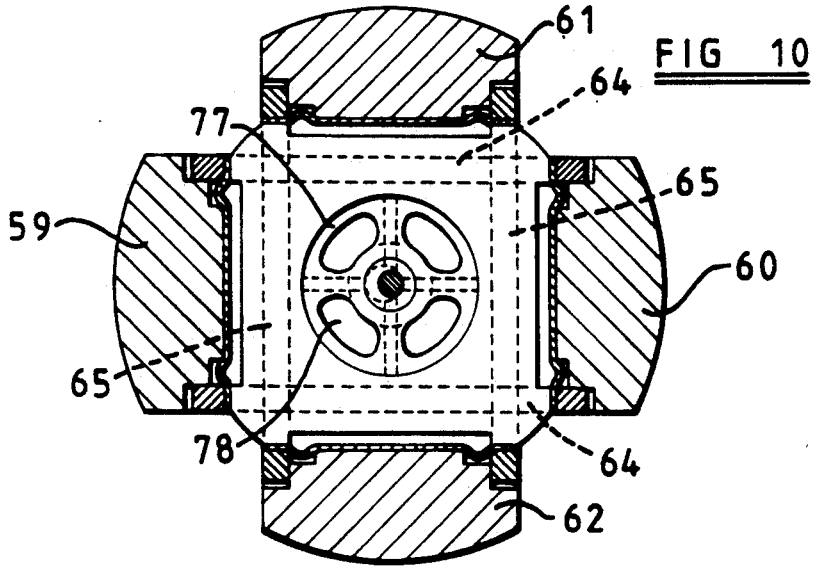
FIG. 10 is a cross-section through the drill bit of FIG. 9.

FIGS. 9 and 10 show diagrammatically a PDC (polycrystalline diamond compact) drill bit incorporating a synchronous modulated bias unit for effecting steering of the bit, during rotary drilling, under the control of a roll stabilised system of any of the kinds according to the invention and described above in relation to FIGS. 1 to 8.

The drill bit comprises a bit body 50 having a shank 51 for connection to the drill string and a central passage 52 for supplying drilling fluid through bores, such as 53, to nozzles such as 54 in the face of the bit.

The face of the bit is formed with a number of blades 55, for example four blades, each of which carries, spaced apart along its length, a plurality of PDC cutters (not shown). Each cutter may be of the kind comprising a circular tablet, made up of a superhard table of polycrystalline diamond, providing the front cutting face, bonded to a substrate of cemented tungsten carbide. Each cutting element is brazed to a tungsten carbide post or stud which is received within a socket in the blade 55 on the bit body.

The gauge portion 57 of the bit body is formed with four circumferentially spaced kickers which, in use, engage the walls of the borehole being drilled and are separated by junk slots.

PDC drill bits having the features just described are generally well known and such features do not therefore require to be described or illustrated in further detail. The drill bit of FIGS. 9 and 10, however, incorporates a synchronous modulated bias unit of a kind which allows the bit to be steered in the course of rotary drilling and the features of such bias unit will now be described.

Each of the four kickers 58 of the drill bit incorporates a piston assembly 59, 60, 61 or 62 which is slideable inwardly and outwardly in a matching bore 63 in the bit body. The opposite piston assemblies 59 and 60 are interconnected by four parallel rods 64 which are slideable through correspondingly shaped guide bores through the bit body so that the piston assemblies are rigidly connected together at a constant distance apart. The other two piston assemblies 61 and 62 are similarly connected by rods 65 extending at right angles below the respective rods 64.

The outer surfaces of the piston assemblies 59, 60, 61, 62 are cylindrically curved in conformity with the curved outer surfaces of the kickers. The distance apart of opposed piston assemblies is such that when the outer surface of one assembly, such as the assembly 60 in FIG. 10, is flush with the surface of its kicker, the outer surface of the opposite assembly, such as 59 in FIG. 10, projects a short distance beyond the outer surface of its associated kicker.

Each piston assembly is separated from the inner end of the bore 63 in which it is slideable by a flexible diaphragm 66 so as to define an enclosed chamber 67 between the diaphragm and the inner wall of the bore 63. The upper end of each chamber 67 communicates through an inclined bore 68 with the central passage 52 in the bit body, a choke 69 being located in the bore 68.

The lower end of each chamber 67 communicates through a bore 70 with a cylindrical radially extending valve chamber 71 closed off by a fixed plug 72. An aperture 73 places the inner end of the valve chamber 71 in communication with a part **52*a* of the central passage 52 below a circular spider/choke 77 mounted in the passage 52. The aperture 73 is controlled by a poppet valve 74 mounted on a rod 75. The inner end of each rod 75 is slidingly supported in a blind bore in the inner end of the plug 72**.

The valve rod 75 extends inwardly through each aperture 73 and is supported in a sliding bearing 76 depending from the circular spider 77. The spider 77 has vertical through passages 78 to permit the flow of drilling fluid past the spider to the nozzles 54 in the bit face, and therefore also acts as a choke to create a pressure drop in the fluid. A control shaft 79 extends axially through the centre of the spider 77 and is supported therein by bearings 80. The lower end of the control shaft 79 carries a cam member 81 which cooperates with the four valve rods 75 to operate the poppet valves 74.

The upper end of the control shaft 79 is detachably coupled to an output shaft 85 which is mounted axially on the carrier of a roll stabilised assembly of any of the kinds previously described. The coupling may be in the form of a mule shoe 86 which, as is well known, is a type of readily engageable and disengageable coupling which automatically connects two shafts in a predetermined relative rotational orientation to one another. One shaft 79 carries a transverse pin which is guided into an open-ended axial slot on a coupling member on the other shaft 85, by engagement with a peripheral cam surface on the coupling member. During steered directional drilling the shafts 85 and 79 remains substantially stationary at an angular orientation, in space, which is controlled as previously described and is determined by the desired output angle which is fed to the control computer 24 of the roll stabilised package.

As the drill bit rotates relatively to the shaft 79 the cam member 81 opens and closes the four poppet valves 74 in succession. When a poppet valve 74 is open drilling fluid from the central passage 52 flows into the associated chamber 67 through the bore 68 and then flows out of the chamber 67 through the bore 70, valve chamber 71, and aperture 73 into the lower end 52*a* of the passage 52, which is at a lower pressure than the upper part of the passage due to the pressure drop caused by the spider 77 and a further choke 82 extending across the passage 52 above the spider 77. This throughflow of drilling fluid flushes any debris from the bores 68 and 70 and chamber 67.

The further choke 82 is replaceable, and is selected according to the total pressure drop required across the choke 82 and spider 77, having regard to the particular pressure and flow rate of the drilling fluid being employed.

As the drill bit rotates to a position where the poppet valve 74 is closed, the pressure in the chamber 67 rises causing the associated piston assembly to be displaced outwardly with respect to the bit body. Simultaneously, due to their interconnection by the rods 64 or 65, the opposed piston assembly is withdrawn inwardly to the position where it is flush with the outer surface of its associated kicker, such inward movement being permitted since the poppet valve associated with the opposed piston assembly will be open.

Accordingly, the displacement of the piston assemblies is modulated in synchronism with rotation of the bit body about the control shaft 79. As a result of the modulation of the displacement of the piston assemblies, a periodic lateral displacement is applied to the drill bit in a constant direction as the bit rotates, such direction being determined by the angular orientation of the shafts 85 and 79. The displacement of the drill bit, as rotary drilling proceeds, determines the direction of deviation of the borehole.

When it is required to drill without deviation, the control shafts 85, 79 are allowed to rotate in space, instead of being held at a required rotational orientation.

FIGS. 9 and 10 illustrate only one form of synchronous modulated bias system suitable for use with a roll stabilised control assembly of the kind to which the present invention relates, and any other suitable form of bias unit may be employed. Examples of alternative forms of bias unit are described in our copending British Patent Application No. 9118618.9.

In the arrangement described, the modulated bias unit is incorporated in the drill bit itself, and such arrangement is preferred. It will be understood, however, that a suitable bias unit could be a separate unit to which the drill bit is coupled, forming part of the bottom hole assembly. If the bias system is incorporated in a separate unit it may be used in conjunction with existing forms of drill bit, or types of bit where it is not possible to incorporate the bias unit in the bit itself.

A major advantage of the described arrangements is that the roll stabilised control assembly may be a completely separate unit from the drill bit, or from the drill bit and bias unit. The roll stabilised instrument package is merely connected to the bias unit by the control shaft 85 and coupling 86, and thus different bias units may be readily coupled with the roll stabilised package. The coupling connecting the roll stabilised assembly to the bias unit may be any form of coupling which may be readily decoupled without affecting the integrity of said assembly or the bias unit. Other suitable couplings will be within the knowledge of the skilled person and do not require to be described in further detail. The ability to decouple the roll stabilised instrument package from the drill bit and/or bias unit is important since the roll stabilised instrument package is costly but has a comparatively long life, whereas the bias unit and drill bit are expendable and comparatively short lived. This may provide a significant advantage over existing controlled steerable rotary drilling systems where the control system and bias mechanism are closely integrated so that the whole system must be discarded when the bias mechanism reaches the end of its life for whatever reason.

We claim:

1. A system for maintaining a downhole instrumentation package in a roll stabilised orientation with respect to a drill string, comprising:

a support connectable to a drill string;

an instrument carrier carried by the support;

means carried by the support for permitting the instrument carrier to rotate about the instrument carrier's longitudinal axis;

a rotatable impeller mounted on the instrument carrier for rotation by a flow of drilling fluid over the impeller;

means coupling the impeller to the instrument carrier for transmitting a torque to the instrument carrier to cause it to rotate about its longitudinal axis relatively to the support in a direction opposite to the direction of rotation of the support and drill string;

sensors carried by the instrument carrier for sensing the rotational orientation of the instrument carrier about its longitudinal axis and producing a signal indicative of said rotational orientation;

control means for controlling, in response to said signal, the torque applied to the instrument carrier to vary the rate of rotation of the instrument carrier relatively to the support, to provide roll stabilisation of the instrument carrier with respect to the support and the drill string.

2. A system according to claim 1, wherein the longitudinal axis of the instrument carrier is coincident with the central longitudinal axis of the drill string.

3. A system according to claim 1, wherein the impeller is rotatably mounted on the instrument carrier for rotation about the longitudinal axis of the instrument carrier.

4. A system according to claim 1, wherein the means coupling the impeller to the instrument carrier include an electro-magnetic coupling acting as an electrical generator, the torque transmitted to the carrier by the coupling being controlled by means to control the electrical load applied to the generator output in response to said output signal from the roll sensors and to a signal indicative of the desired rotational orientation of the carrier.

5. A system according to claim 4, wherein the impeller is rotatable relatively to the carrier and the electromagnetic coupling, acting as an electrical generator, comprises a rotor rotating with the impeller and a stator fixed to the carrier.

6. A system according to claim 5, wherein the stator is located within an internal compartment of the carrier and the rotor is located externally of the carrier, the rotor and stator being separated by a cylindrical wall of said compartment.

7. A system according to claim 5, wherein both the rotor and stator of the electrical generator are located within an internal compartment of the carrier, the impeller being coupled to the rotor by a transmission through a wall of said compartment.

8. A system according to claim 7, wherein said transmission includes a magnetic coupling acting across said wall of the compartment.

9. A system according to claim 7, wherein a reduction gearbox is connected between the impeller and the rotor of the electrical generator.

10. A system according to claim 1, wherein the means for controlling the torque applied to the instrument carrier include controllable braking means applied between the carrier and the aforesaid support on which the carrier is rotatably mounted.

11. A system according to claim 10, wherein said braking means are located within an internal compartment of the carrier and are connected to said support by a transmission which includes a magnetic coupling acting across a wall of the compartment.

12. A system according to claim 10, wherein the impeller is directly mechanically coupled to the carrier.

13. A system according to claim 10, wherein the braking means comprise an electrical generator having a rotor connected to the support and a stator connected to the instrument carrier, the torque absorbed by the generator being controlled by means to control the electrical load applied to the generator output in response to said output signal from the roll sensors and to a signal indicative of the desired rotational orientation of the carrier.

14. A system according to claim 13, wherein a reduction gearbox is connected between the rotor and the support.

15. A system according to claim 4, wherein the electrical generator driven by the impeller supplies electrical power to an electric servo motor, carried by the instrument carrier, which servo motor has an output shaft connected to the support to effect rotation of the instrument carrier relatively to the support.

16. A system according to claim 15, wherein the output shaft of the servo motor is connected to the support through a magnetic coupling.

17. A system according to claim 15, wherein the output shaft of the servo motor is connected to the support through a reduction gearbox.

18. A system according to claim 1, wherein the means coupling the impeller to the instrument carrier for transmitting a torque thereto comprises:

a first shaft rotatably mounted on the instrument carrier;

means drivably coupling the impeller to the first shaft;

a second shaft rotatably mounted on the instrument carrier;

means coupling the second shaft to the support on which the instrument carrier is rotatably mounted;

a differential gear mechanism coupling the first shaft to the second shaft;

an electro-magnetic motor/generator mounted on the instrument carrier and connected to the differential gear mechanism to transmit torque from said mechanism to the instrument carrier; and means controlling the motor/generator, in response to the aforesaid signal indicative of the rotational orientation of the instrument carrier, to control the torque applied to the instrument carrier.

19. A system according to claim 18, and further comprising an electrical generator driven by the impeller, the generator comprising a rotor driven by said first shaft and a stator mounted on the instrument carrier.

20. A method of maintaining a downhole instrumentation package in a roll stabilised orientation with respect to a drill string, comprising the steps of:

mounting the instrumentation package in an instrument carrier which is rotatable about a longitudinal axis relatively to the drill string;

rotating the instrument carrier about its longitudinal axis by means of an impeller disposed in a flow of drilling fluid passing along the drill string; and controlling the torque applied to the instrument carrier, in response to signals indicative of the rotational orientation of the instrument carrier, to vary the rate of rotation of the instrument carrier relatively to the drill string to provide roll stabilisation of the instrument carrier with respect to the drill string.

21. A method according to claim 20, wherein the torque applied to the instrument carrier is controlled by controlling a variable coupling between the impeller and the instrument carrier to vary the torque transmitted to the instrument carrier by the impeller.

22. A method according to claim 20, wherein the torque applied to the instrument carrier is controlled by applying a brake to the instrument carrier to absorb a proportion of the torque applied to the instrument carrier by the impeller.

23. A steerable rotary drilling system comprising:

a support connectable to a drill string;

an instrument carrier carried by the support;

means carried by the support for permitting the instrument carrier to rotate about the instrument carrier's longitudinal axis;

means for transmitting a torque to the instrument carrier to cause it to rotate about its longitudinal axis relatively to the support in a direction opposite to the direction of rotation of the support and drill string;

sensors carried by the instrument carrier for sensing the rotational orientation of the instrument carrier about its longitudinal axis and producing a signal indicative of said rotational orientation;

control means for controlling, in response to said signal, the torque applied to the instrument carrier to vary the rate of rotation of the instrument carrier relatively to the support to provide roll stabilization of the instrument carrier;

a bottom hole assembly including a drill bit and a synchronous modulated bias unit including means for applying to the drill bit a displacement having a lateral component at right angles to the axis of rotation of the drill bit;

an output control shaft coupled between the instrument carrier and the bias unit, the rotational orientation of the shaft represents a desired direction of steering;

means operated by rotation of the bias unit relatively to said output control shaft for modulating the lateral displacement component in synchronism with rotation of the bias unit and in a phase relation thereto determined by the rotation orientation of the control shaft, whereby the maximum value of the lateral displacement component is applied to the drill bit at a rotational orientation of the bias unit dependent on the rotational orientation of the control shaft, thereby to cause the drill bit to become displaced laterally in the desired direction as drilling continues; and means for readily decoupling the control shaft from the instrument carrier and the bias unit.

24. A steerable rotary drilling system according to claim 22, wherein the bias unit is incorporated in the drill bit.

* * * * *